US009980868B2

(12) United States Patent
Sabota et al.

(10) Patent No.: US 9,980,868 B2
(45) Date of Patent: May 29, 2018

(54) WARMING THERAPY DEVICE WITH INTEGRATED MOVEABLE VIDEO AND STILL CAMERA

(71) Applicant: Segars California Partners, LP, Austin, TX (US)

(72) Inventors: Peter D. Sabota, Austin, TX (US); John Segars, Austin, TX (US); Christopher A. Dykes, Columbia, MD (US); Michael H. Mackin, Ellicott City, MD (US)

(73) Assignee: SEGARS CALIFORNIA PARTNERS, LP, Austin, TX (US)

( * ) Notice: Subject to any disclaimer, the term of this patent is extended or adjusted under 35 U.S.C. 154(b) by 266 days.

(21) Appl. No.: 14/773,370

(22) PCT Filed: Mar. 15, 2014

(86) PCT No.: PCT/US2014/029923

§ 371 (c)(1),
(2) Date: Sep. 7, 2015

(87) PCT Pub. No.: WO2014/145201

PCT Pub. Date: Sep. 18, 2014

(65) Prior Publication Data

US 2016/0015587 A1 Jan. 21, 2016

Related U.S. Application Data

(60) Provisional application No. 61/835,525, filed on Jun. 14, 2013, provisional application No. 61/789,202, filed on Mar. 15, 2013.

(51) Int. Cl.
*A61G 11/00* (2006.01)
*A61G 13/10* (2006.01)

(52) U.S. Cl.
CPC ..... *A61G 11/00* (2013.01); *A61G 11/003* (2013.01); *A61G 13/107* (2013.01); *A61G 2203/20* (2013.01); *A61G 2203/30* (2013.01)

(58) Field of Classification Search
CPC ... A61G 11/00–11/009; A61G 2203/20; A61G 5/00–5/14; A61G 10/00–10/04; A61G 12/00–12/008; A61G 14/00–14/18
See application file for complete search history.

(56) References Cited

U.S. PATENT DOCUMENTS

| | | | | |
|---|---|---|---|---|
| 7,038,588 | B2 | 5/2006 | Boone et al. | |
| 7,255,671 | B2 | 8/2007 | Boone et al. | |
| 8,535,214 | B2 | 9/2013 | Chilton, III | |
| 2002/0196141 | A1* | 12/2002 | Boone | A61B 5/02055 340/540 |
| 2004/0236174 | A1* | 11/2004 | Boone | A61B 5/02055 600/21 |
| 2012/0130200 | A1* | 5/2012 | Cipriano | A61B 5/08 600/301 |

(Continued)

*Primary Examiner* — Thaddeus Cox
(74) *Attorney, Agent, or Firm* — Barnes & Thornburg LLP

(57) ABSTRACT

An integrated and movable video and/or still camera is integrated into a warming therapy device to allow caregivers to point the camera in an area of interest in which they are interested in recording or displaying the patient located on a support surface. The system may include an audio recording device.

11 Claims, 6 Drawing Sheets

(56) References Cited

U.S. PATENT DOCUMENTS

| | | | | |
|---|---|---|---|---|
| 2014/0179984 | A1 | 6/2014 | Cipriano | |
| 2014/0221728 | A1* | 8/2014 | Bodlaender ..... | A61G 11/00<br>600/22 |
| 2015/0161868 | A1 | 6/2015 | Richards et al. | |

* cited by examiner

WARMING THERAPY DEVICE WITH INTEGRATED MOVEABLE VIDEO AND STILL CAMERA

CROSS-REFERENCE TO RELATED APPLICATIONS

This application claims the benefit of U.S. Provisional applications 61/789,202 filed Mar. 15, 2013 and 61/835,525 filed Jun. 14, 2013.

BACKGROUND

This disclosure relates to the field of various infant warming devices that are used to provide heat support to premature infants who cannot sustain their own body temperature. In the treatment of infants, and particularly those born prematurely, it is necessary to provide heat to the infant during the care and treatment of the infant and to minimize heat loss from the infant's body. An apparatus for providing such heat will be referred to in this disclosure as an infant warming device. In general such an apparatus comprises a flat planar surface on which the infant rests while various procedures are carried out. There are normally protective guards that surround the infant and some type of overhead heater directing radiant energy toward the infant. It should be understood that these infant warming devices might have other descriptive names, such as, for example, an infant care device, or an infant care center, patient care center, an infant incubator, or a combination device, and this disclosure anticipates any of those other names. This disclosure will use the term infant warming device.

Above and beyond these basic functions of an infant warming device there are many other functions that can be useful for infant care. This disclosure will describe one of those.

Infant Warming devices currently only have integrated fixed lens cameras. The use of a fixed lens limits where the center of interest is on the video and the display. In infant care there are frequently situations in which caregivers are extremely interested in viewing a localized area on the infant bed or mattress. The use of a moveable integrated camera would allow the clinician to select the region of interest for viewing and playback and to control the focus.

There is a need then for a system that enables the caregiver to move and focus the camera.

There are many reasons it would be valuable to have a video camera and the ability to display, record and playback the image videoed. It would be a great teaching and learning tool for caregivers in how to perform procedures on patients. Reviewing real experiences of a code or infant resuscitation could benefit care quality with staff learning from their own or others good and bad performance.

The recorded record could be used to defend the actions of caregivers in litigation cases. It could be used to record messages for playback to communicate between staff or staff and parents. It could be used to allow distant parents or other patient relatives to view the patient infant from a long distance through the Internet. It could be used to record infant motion over a long time and then play back at high speed looking for seizure episodes. It would even be possible to add the ability to have the machine scan the recording looking for motion that is indicative of seizure episodes based upon appropriate algorithms. It would allow remote viewing of the patient by remote caregivers who could prompt caregivers attending the patient in real time. It could allow caregivers to view the patient during crowded rounds by displaying the video feed remotely or on the infant care device display.

BRIEF SUMMARY

This need can be met by incorporating into the warming therapy device an integrated video and/or still camera and audio recording device that is moveable within the infant warming device to enable the clinician to point the camera to the area of interest in which they are interested in recording or displaying on the patient located on support surface. Although this could alternately be accomplished by creating on on-screen display of areas of interest on the patient or patient support surface and then manipulate the image digitally to show the region of interest however this would occur with a loss of resolution that is not experienced in the moveable camera. The described moveable integrated camera could also stream the video out of the infant warming device and be displayed and viewed remotely by a clinician who requests different angles of the patient or a close up view.

This need can be met by an infant warming device including a patient bed, supporting sidewalls, and associated warming mechanisms, including at least: a vertical column structure mounted on the infant warming device and supporting a radiant heater head; and a movable camera and audio recording device mounted either in or below the radiant heater head.

DESCRIPTION OF DRAWINGS

There are disclosed in the drawings and detailed description to follow various embodiments of the solution proposed herein. It should be understood, however, that the specific embodiments given in the drawings and entailed description do not limit the disclosure. On the contrary, they provide the foundation for discerning the alternative forms, equivalents, and modifications that will be encompassed in the scope of the eventual claims.

DETAILED DESCRIPTION

Figure 1:
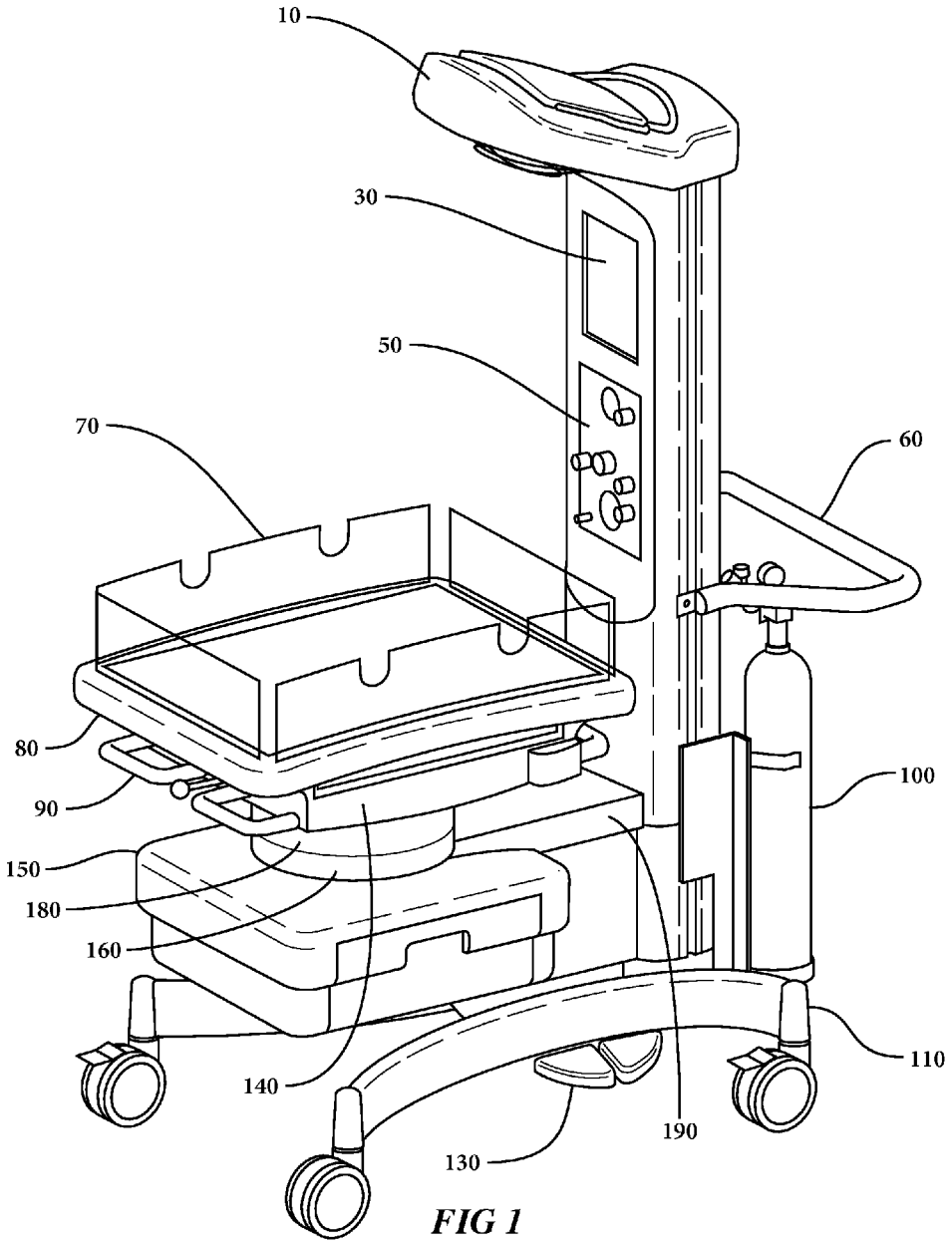
FIG. 1 is a view of an infant warming center that can include the inventive concept described in this disclosure.
Figure 2:
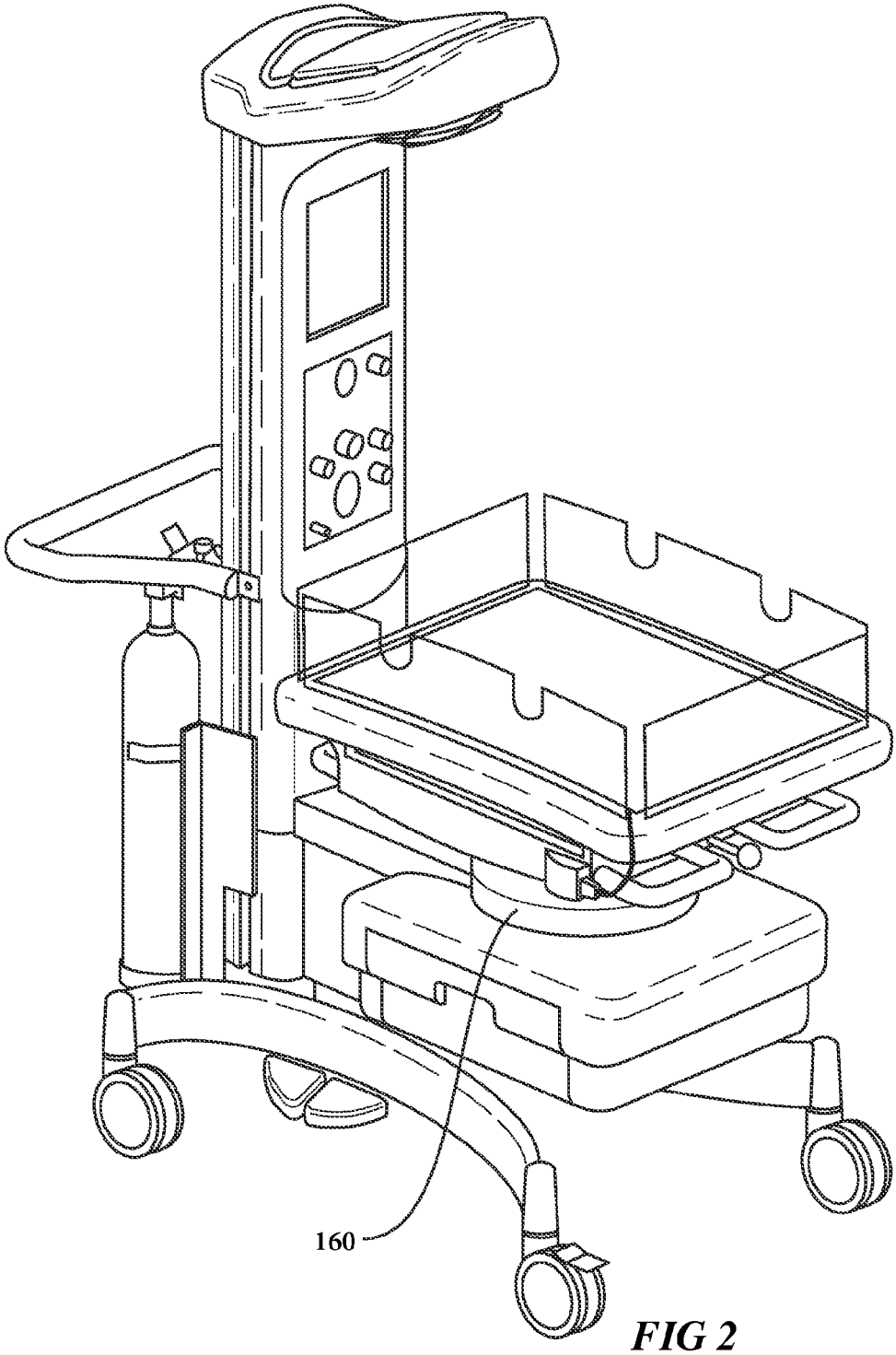
FIG. 2 is an alternate view of an infant warming center that can include the inventive concept described in this disclosure.
Figure 3:
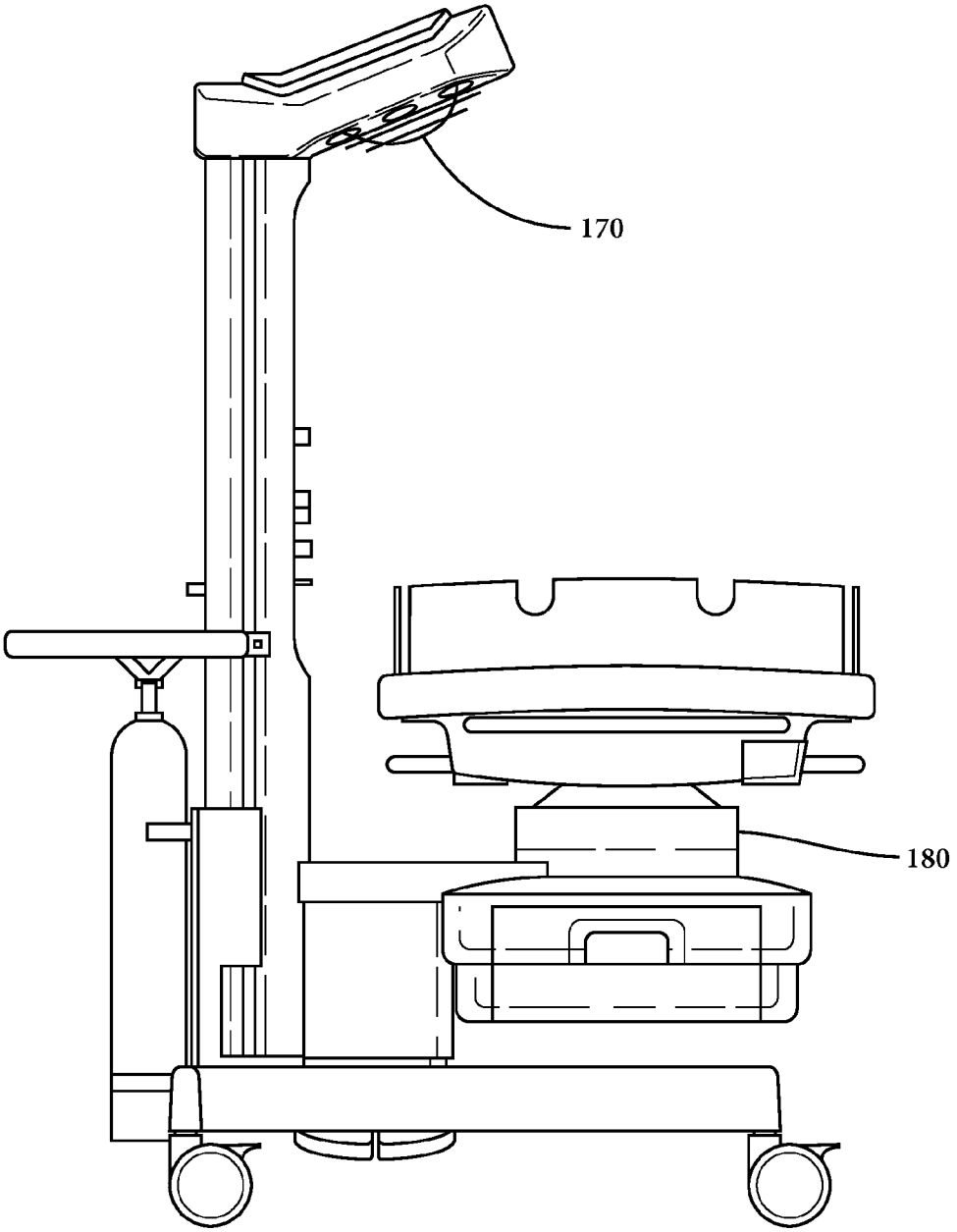
FIG. 3 is an alternate view of an infant warming center that can include the inventive concept described in this disclosure.

Referring now to FIGS. 1, 2, and 3, several views of an infant warming center that can include the inventive concept to be described in this disclosure. The center includes an infant bed 80 that underlies an infant positioned thereon. The infant bed has a surrounding sidewall 70 and rides upon a patient support mechanism 140. The patient bed and surrounding sidewalls may enclose a heated mattress. A vertical column structure mounted on the infant warming center supports a radiant heater head 10, containing a radiant heater 170 (FIG. 3), with that radiant heater. The radiant heater assembly is designed to optimize the heat focused on the infant. The vertical column structure may have a user interface/display 30 which can act as a display for the images recorded by the camera. The column may include a resuscitation module 50. The infant warming device's main computer controller may reside in the vertical column structure or may reside in the patient support mechanism. Handles 60, 90, are used to move the infant warming device around as it can be moved on flat surfaces via legs 110 with attached wheels and controlled with footswitches 130. On the rear side of the column is a location for carrying a remote gas supply tank 100. Under the patient support mechanism 140 is a cantilever cover 160 and turret cover 180 for shrouding the rotation mechanisms, with a cantilever arm 190 that supports the patient support, vertical column, and supports a storage enclosure 150.

Figure 4:
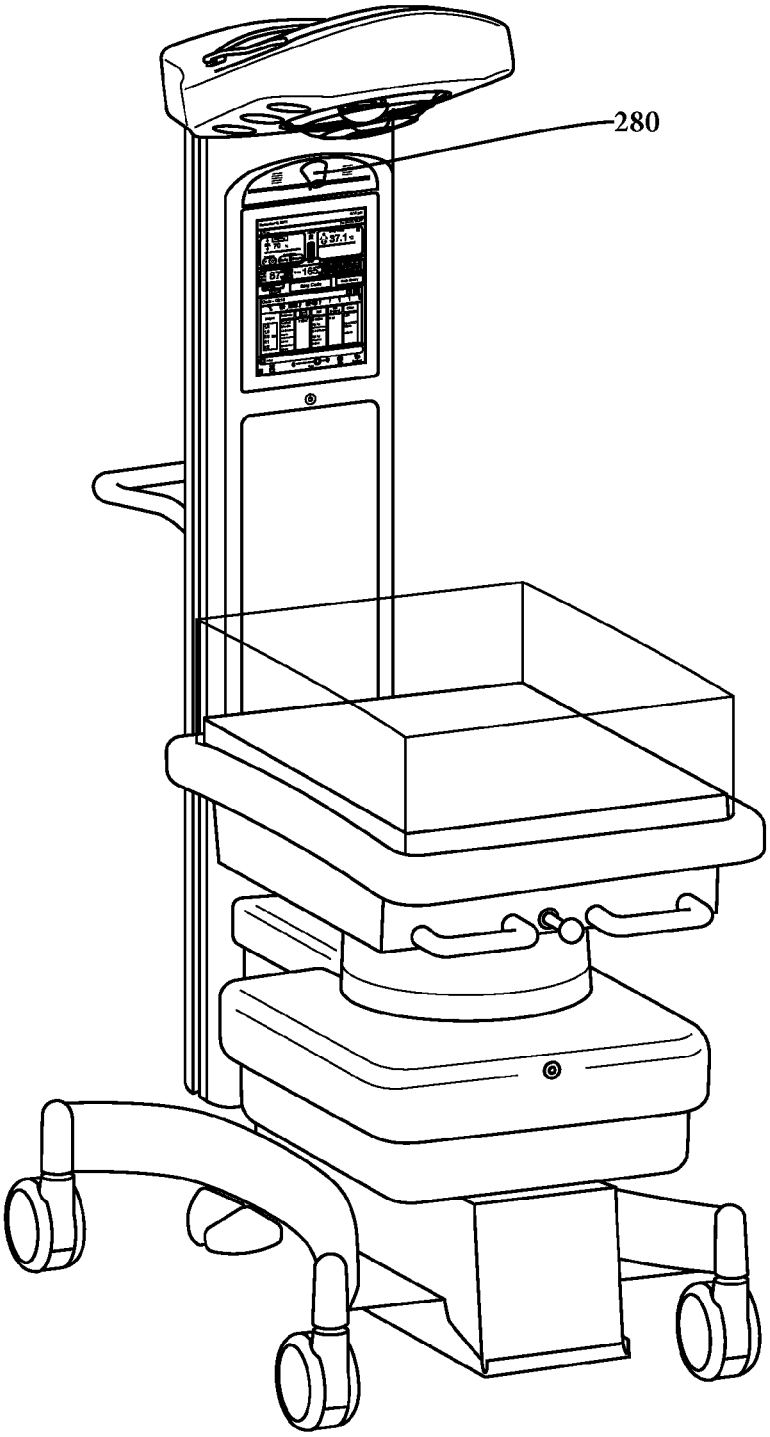
FIG. 4 is a view illustrating the location of the movable video or still camera.

One implementation of the proposal is shown in FIG. 4. A movable camera can be located in the heater head or the top of the vertical column. The system would also include an audio recording device for recording any sounds or messages along with the video content. The camera may be aimed at the bed or out toward the front of the infant warming device at the caregiver. The aim would be selected by the operator to either give a view of the patient or the caregiver. One reason for focusing on the caregiver is to video recorded message to communicate at a later time with the parents or for a live communication with the parents who might be at a different location. The movable camera could be a still camera, a video camera, or a composite video still camera. The described moveable integrated camera could also stream the video out of the device and be displayed and viewed remotely by a clinician who requests different angles of the patient or a close up view.

In one embodiment of this system the combined movable camera and audio recording system would be displayed as a real time video of the patient on the on-device display 30.

In another embodiment of the system the combined movable camera and audio recording system would allow on-device display of pre-recorded audio and video.

In another embodiment of the system the combined movable camera and audio recording system would allow on device display of pre-recorded audio and video messages.

Figure 5:
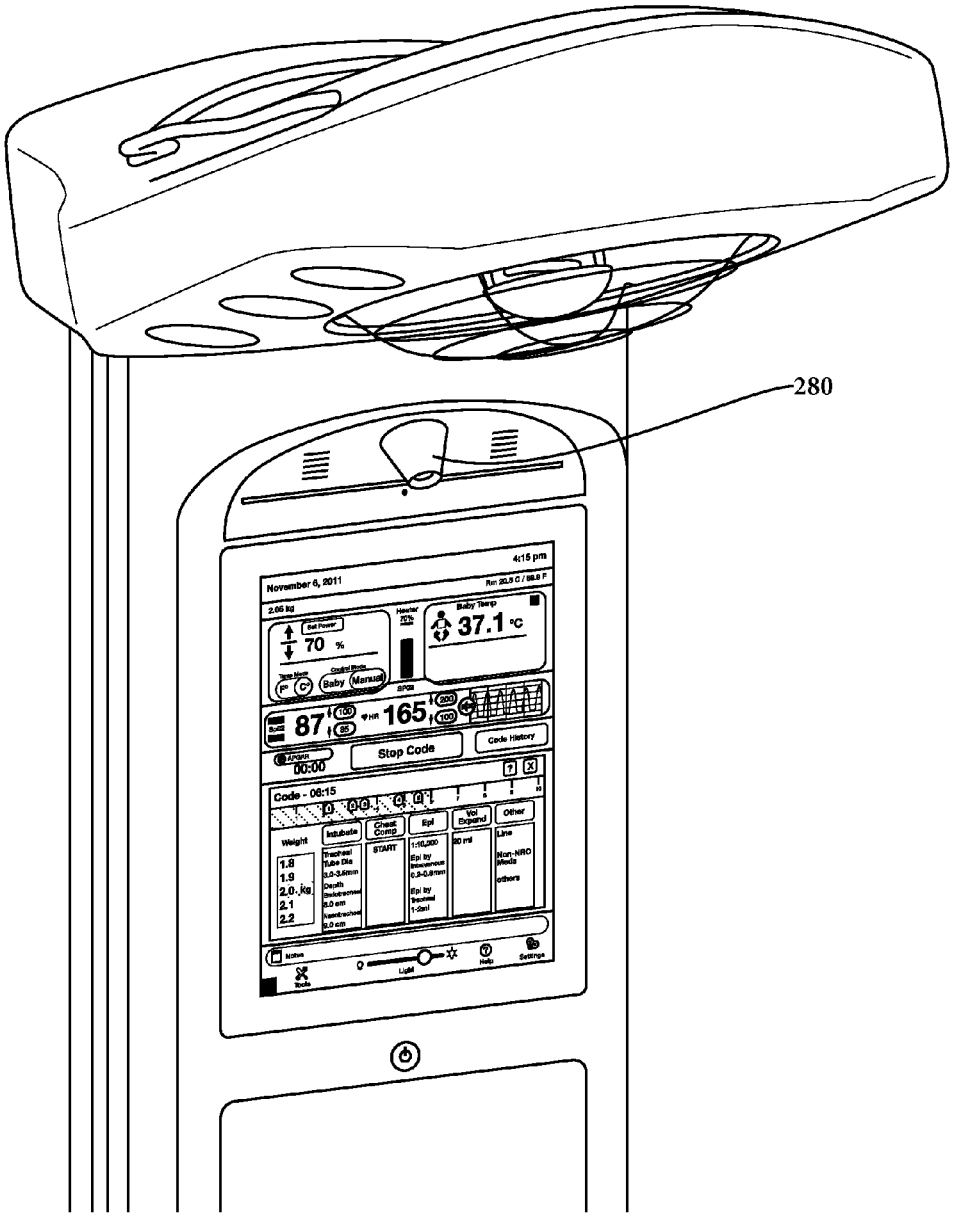
FIG. 5 is a more detailed view illustrating the location of the movable video or still camera above the integrated touch screen.

FIG. 5 is a more detailed view illustrating the location of the movable video and/or still camera above the integrated touch screen.

Figure 6:
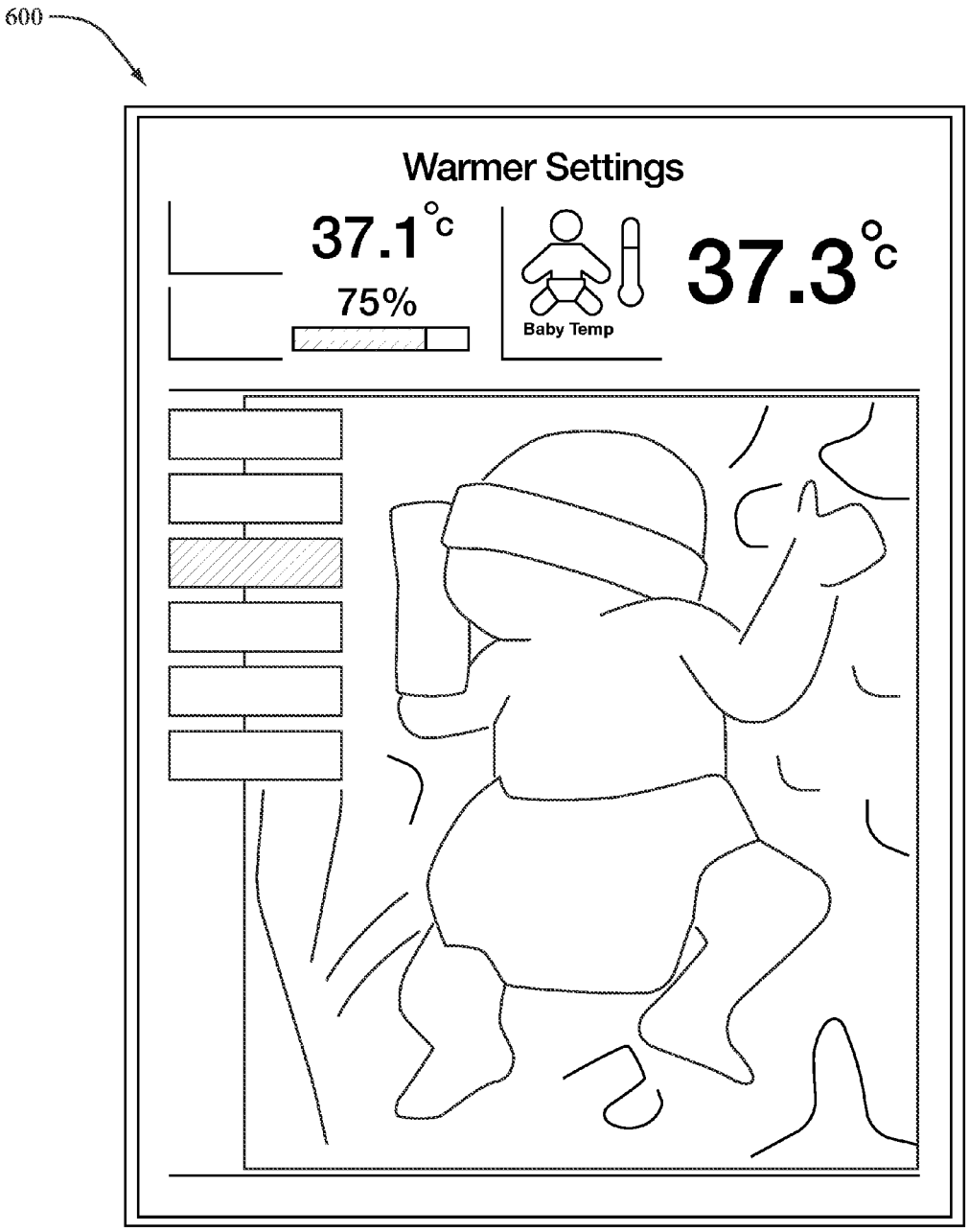
FIG. 6 is an illustration of a video display of an infant patient in an infant warming center.

As envisioned the infant warming device would have storage and playback capability built in and have the ability to transmit the image stream from the movable camera through a cable or wireless feed to a hospital information system. The device could also continuously display the image on the infant warming device screen as illustrated in FIG. 6; which allows the visualization of the infant from across the room where the care giver might be attending another patient. The live image might also be displayed at a central nursing station or to various locations within the hospital.

As mentioned, the proposal includes output for hardwire and wireless connection to a hospital information system. It also includes connection through USB or similar connection for downloading onto storage media such as memory stick or DVD.

Having the video camera built into the infant warming device provides a number of advantages over other systems where the camera is independent. The camera can be located in an ideal location that always has an unobstructed view of the patient. The camera aim never needs to be adjusted if the bed is moved as is the case with a camera mounted to a wall or ceiling The camera can be controlled directly at the patient bed so it can be turned on even after a caregiver is already involved with the infant during a procedure or CODE situation and might not be able to leave the bedside. There are no wires or cords needed to connect the camera to a recording or viewing system. The camera can be optimized since the distance between the camera and the patient is fixed.

There are many reasons it would be valuable to have a video camera and the ability to display, record and playback the image videoed, and to record audio messages as well. It would be a great teaching and learning tool for caregivers in how to perform procedures on patients. Reviewing real experiences of a code or infant resuscitation could benefit care quality with staff learning from their own or others good and bad performance. The recorded record could be used to defend the actions of caregivers in litigation cases. It could be used to record audio messages for playback to communicate between staff or staff and parents. It could be used to allow distant parents or other patient relatives to view the patient infant from a long distance through the Internet. It could be used to record infant motion over a long time and then play back at high speed looking for seizure episodes. It would even be possible to add the ability to have the machine scan the recording looking for motion that is indicative of seizure episodes based upon appropriate algorithms. It would allow remote viewing of the patient by remote caregivers who could prompt caregivers attending the patient in real time. It could allow caregivers to view the patient during crowded rounds by displaying the video feed remotely or on the infant warming device display.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

What is claimed is:

1. An infant warming device comprising:

a wheeled base, a cantilevered arm attached to the base, a vertical column supported on the cantilevered arm, the vertical column housing a main controller and a touch-screen display, a patient support mechanism positioned above the cantilevered arm, a radiant heater coupled to the vertical column and positioned to optimize heat on the patient support mechanism, and a movable camera positioned in the vertical column, the movable camera configured to provide an output to the touch-screen display to permit the touch-screen display to show real-time images of the patient support mechanism, wherein the movable camera includes a combined video camera and audio recording device that is configured to display pre-recorded audio and video.

2. The infant warming device of claim 1 further comprising an audio recording device situated in the vertical column.

3. The infant warming device of claim 2 wherein the movable camera includes a still camera.

4. The infant warming device of claim 2 wherein the movable camera includes a composite video/still camera.

5. The infant warming device of claim 2, wherein the infant warming device has storage and playback capability built in and has the ability to transmit a video and/or video stream from the movable camera through a cable or wireless feed to a hospital information system.

6. The infant warming device of claim 2, wherein the infant warming device includes output for hardwire and wireless connection that includes connection through a USB connection for downloading onto a storage medium.

7. The infant warming device of claim 1, wherein the infant warming device has storage and playback capability built in and has the ability to transmit a video and/or video stream from the movable camera through a cable or wireless feed to a hospital information system.

8. The infant warming device of claim 1, wherein the infant warming device includes output for hardwire and wireless connection that includes connection through a USB connection for downloading onto a storage medium.

9. An infant warming device comprising:

a wheeled base, a cantilevered arm attached to the base, a vertical column supported on the cantilevered arm, the vertical column housing a main controller and a touch-screen display, a patient support mechanism positioned above the cantilevered arm, a radiant heater coupled to the vertical column and positioned to optimize heat on the patient support mechanism, and a movable camera positioned in the vertical column, the movable camera configured to provide an output to the touch-screen display to permit the touch-screen display to show real-time images of the patient support mechanism, wherein the movable camera includes a combined video camera and audio recording device that is configured to display pre-recorded audio and video messages.

10. The infant warming device of claim 9, wherein the infant warming device has storage and playback capability built in and has the ability to transmit a video and/or video stream from the movable camera through a cable or wireless feed to a hospital information system.

11. The infant warming device of claim 9, wherein the infant warming device includes output for hardwire and wireless connection that includes connection through a USB connection for downloading onto a storage medium.

* * * * *